US007786624B2

(12) United States Patent
Haas

(10) Patent No.: US 7,786,624 B2
(45) Date of Patent: Aug. 31, 2010

(54) POWER CONTROL DEVICE

(76) Inventor: Norman C. Haas, 11408 Robinson St., Overland Park, KS (US) 66210

( * ) Notice: Subject to any disclaimer, the term of this patent is extended or adjusted under 35 U.S.C. 154(b) by 0 days.

(21) Appl. No.: 12/419,852

(22) Filed: Apr. 7, 2009

(65) Prior Publication Data

US 2009/0189462 A1 Jul. 30, 2009

Related U.S. Application Data

(63) Continuation of application No. 11/366,083, filed on Mar. 2, 2006, now Pat. No. 7,582,990.

(51) Int. Cl.
*H01H 3/00* (2006.01)

(52) U.S. Cl. ..... 307/142; 307/119; 439/133; 439/346

(58) Field of Classification Search ..... 307/119, 307/142; 439/133, 346; 200/50.28
See application file for complete search history.

(56) References Cited

U.S. PATENT DOCUMENTS 3,942,856 A * 3/1976 Mindheim et al. ..... 200/51.09
4,482,789 A 11/1984 McVey
5,169,326 A 12/1992 Werner
5,338,218 A 8/1994 Haas
6,011,328 A 1/2000 Smith
7,080,889 B2 7/2006 Ling et al.

OTHER PUBLICATIONS

Select file history of related U.S. Appl. No. 11/366,083, dated Jun. 16, 2008 through Apr. 3, 2009, 68 pages.

* cited by examiner

*Primary Examiner*—Albert W Paladini
*Assistant Examiner*—Daniel Cavallari
(74) *Attorney, Agent, or Firm*—Lathrop & Gage LLP

(57) ABSTRACT

A power control device prevents unauthorized and unwanted use of electrical devices by locking the plug of the electrical device in the power control device, when the current flowing through the power control device is stopped. The device includes a switch, moveable between on and off conditions by moving a slide lock or bolt, typically by rotating a key in a locking structure. When the slide lock has moved into contact with the switch, such that it is in an off-condition and current is not flowing through the power control device, the slide lock has also locked the plug in the power control device. The electrical device is temporarily inoperable and can not resume normal operation until the power control device is unlocked.

12 Claims, 12 Drawing Sheets

POWER CONTROL DEVICE

CROSS-REFERENCES TO RELATED APPLICATIONS

This application is a continuation application of commonly owned U.S. patent application Ser. No. 11/366,083, entitled: Power Control Device, filed on Mar. 2, 2006 now U.S. Pat. No. 7,582,990, the disclosure of which is incorporated by reference herein.

TECHNICAL FIELD

The present invention relates to the field of a power control devices for selectively disabling current flow through the device, and locking a plug in the device when the current flow through the device has been disabled.

BACKGROUND OF THE INVENTION

Users of electrical devices often do not like or do not permit others to use their devices. For example, the device may be set to the user's personal settings, that if used by another would change the settings. Additionally, in the case of computers, there may be sensitive information, or settings on the computer, that the user does not want anyone to see, and wants the settings kept unchanged. Additionally, users of electrical devices simply do not want others using these devices, as this places additional wear and tear on these devices, limiting the user's time for enjoying these devices during their usable life.

SUMMARY OF THE INVENTION

The present invention is directed to a power control device that prevents unauthorized and unwanted use of electrical devices, typically large electrical devices, such as televisions, computers, and the like, that are difficult to remove from their present locations, due to their size and/or positioning (for example, on shelves, behind desks, in overhead mounts, etc.). The power control device is such that it receives a plug of the electrical device, and allows for the passage of electric current through the power control device, from the current source to the electrical device when the power control device is unlocked. When the power control device is locked, typically by turning a key, electric current flow through the power control device is stopped, and the plug is locked in the power control device. The key is removable when in the locked position. In the locked position, the plug can not be removed from the power control device, without severely damaging or destroying the power control device.

The present invention also provides an inexpensive, portable, and convenient device that is operable to prevent unauthorized use of electrical appliances and other electrical devices. Such a power control device is useful, for example, with computers, television sets, radios, power tools, and other electrical devices, to interrupt the power to the electrical device and prevent an unauthorized user from plugging the electrical device into an electrical receptacle other than the power control device, thereby circumventing the effectiveness of the electrical device. The power control device of the invention is simple, convenient, inexpensive to manufacture, easy to use, and effective at preventing unauthorized use of an electrical device, to which it attaches, through the plug of the electrical device.

An embodiment of the invention is directed to a power control device, that prevents unauthorized and unwanted use of electrical devices by locking the plug of the electrical device in the power control device, when the current flowing through the power control device is stopped. The device includes a switch, moveable between on and off conditions, by moving a slide lock or bolt, typically by rotating a key in a locking structure. When the slide lock has moved into contact with the switch, such that it is in an off-condition and current is not flowing through the power control device, the slide lock has also locked the plug in the power control device. The electrical device is temporarily inoperable and can not resume normal operation until the power control device is unlocked.

Another embodiment of the invention is directed to a power control device. The device has a first contact for electrical communication with a first prong of a plug, the first contact for electrical communication with a current source, and a second contact for electrical communication with a second prong of the plug. There is also a switch in electrical communication with the second contact and for electrical communication with the current source. The switch is movable between an on-condition, where electric current flows through the switch, and an off-condition, where electrical current does not flow through the switch. There is also a moveable member, for example, a slide lock or bolt, moveable (slideable) between a first position and a second position. The moveable member has a first portion for causing the switch to move between the on-condition, when the movable member is in the first position, and the off-condition, when the moveable member is in the second position, and, a second portion for locking the plug in the device when the movable member has moved to the second position.

Another embodiment of the invention is directed to a power control device. The power control device includes a first contact for electrical communication with a first power prong of a plug, the first contact for electrical communication with a current source, and a second contact for electrical communication with a second power prong of the plug. There is also a switch in electrical communication with the second contact and for electrical communication with the current source. The switch is movable between an on-condition, where electric current flows through the switch, and an off-condition, where electric current does not flow through the switch. There is a key lock assembly and a moveable member in communication with the key lock assembly, for moving the switch between the on-condition and the off-condition, and engaging a plug in the device. The movable member is moved by the key lock assembly, between a first position, where the switch is in an on-condition and the plug is not engaged, and a second position, where the switch is in the off-condition and the plug is engaged.

Another embodiment of the invention is directed to a power control device. The power control device includes, a first contact, a second contact, and, a switch, electrically coupled to at least one of the first contact or the second contact. The first contact, the second contact, and the switch form a portion of a circuit that couples with a current source. When the power prongs of a plug are in electrical contact with the first contact and the second contact, the first contact, second contact, switch, current source and the electrical device, associated with the power prongs of the plug, define a circuit. There is also a bolt, movable between positions, for activating and deactivating the switch, such that the portion of the circuit configured for coupling with the current source and the electrical device is closed and opened upon movement of the bolt between the positions. The bolt includes a portion for engaging the power prongs of a plug, when the bolt is in a position where the switch is deactivated.

Another embodiment of the invention is directed to a method for controlling the flow of power to an electrical device. The method includes providing a power control device including, a first contact, a second contact, and a switch, electrically coupled to at least one of the first contact or the second contact. The first contact, the second contact, and the switch form a portion of a circuit that couples with a current source. When the power prongs of a plug are in electrical contact with the first contact and the second contact, the first contact, second contact, switch, current source and the electrical device, associated with the power prongs of the plug, define a circuit. There is also a bolt, movable between positions, for activating and deactivating the switch, such that the portion of the circuit configured for coupling with the current source and the electrical device is closed and opened upon movement of the bolt between the positions. The bolt includes a portion for engaging the power prongs of a plug, when the bolt is in a position where the switch is deactivated. The bolt is in a position where the switch is activated.

The power control device is then coupled to a current source. A plug, in electrical communication with an electrical device, is attached to the power control device, such that the a first power prong of the plug is in contact with the first electrical contact, and the second power prong of the plug is in contact with the second electrical contact. The bolt is moved to a position where the switch is deactivated. Accordingly, electric current is no longer flowing between the source of electric current and the plug, and the plug is locked in the power control device.

BRIEF DESCRIPTION OF THE DRAWINGS

Attention is now directed to the drawing figures, wherein like reference numerals or characters indicate corresponding or like components. In the drawings.

DETAILED DESCRIPTION

The present invention provides an apparatus (device) for conveniently controlling the supply of power to an electrical device. The power control device of the present invention minimizes the number of parts, particularly the number of moving parts, so that the power control device is inexpensive to manufacture, reliable, and extremely unlikely to malfunction. The power control device provides a high degree of reliability for enabling or disabling power supplied to an electrical device.

In addition, the power control device may be provided with an electrical connector or cord having electrical leads connected to a plug that may be plugged into an electrical receptacle (also known throughout this document as an outlet or socket). This allows the power control device to be operable at a distance from the electrical receptacle. Thus, if the electrical receptacle is located behind furniture or in another location that is not readily or conveniently accessible, the power control device may be operable in a more readily accessible location. Alternately, an electrical plug may be mounted or molded into the housing of the power control device.

The power control device is key-operable for easy and secure usage. A removable key, when inserted into a locking structure and turned or rotated, is operable to lock the plug of the electrical device into the housing of the power control device and to stop power from flowing to the electrical device plug. Therefore, the power control device is easy to use and effectively and securely eliminates unauthorized usage of the electrical device.

The present invention is shown for use with plugs that are, for example, standard two prong plugs (Type A) (Class II ungrounded plug) and three prong plugs (Type B) (Class I plug, U.S. Standard NEMA 5-15 plug, Canadian Standard CS22.2, no 42), for standard North American (U.S. and Canada) and Central American electrical receptacles (outlets or sockets). Accordingly, in this document, "plugs", "standard plugs" and "outlets" are standard North American, and Central American plugs and their corresponding outlets (sockets), in which they are received. This is exemplary only, and in no way limiting of the invention, as the invention is easily modifiable and adaptable to all other plugs, as used throughout the world.

Figure 1A:
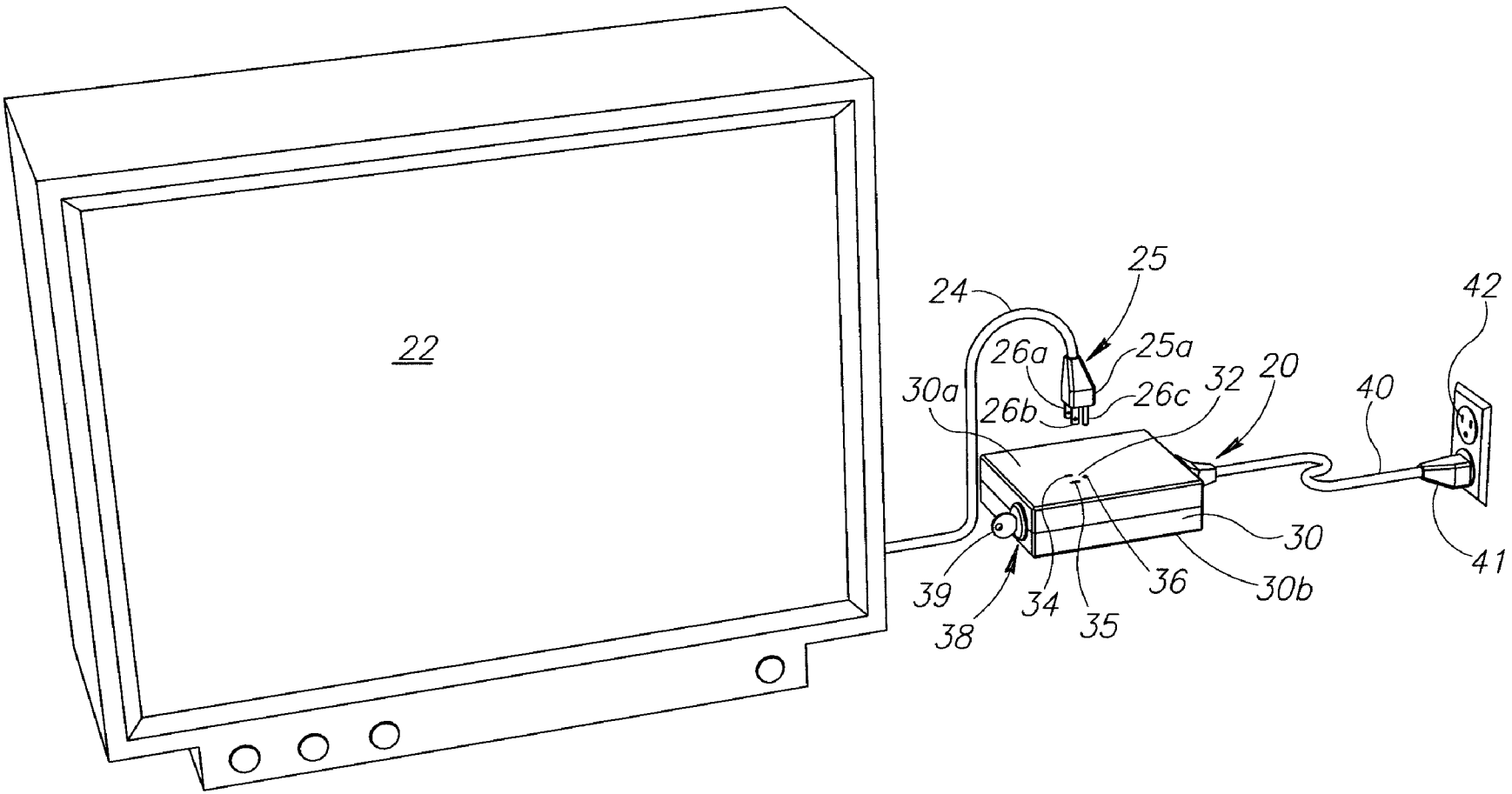
FIGS. 1A-1C are perspective views of an embodiment of the invention in a series of exemplary operations.
Figure 1B:
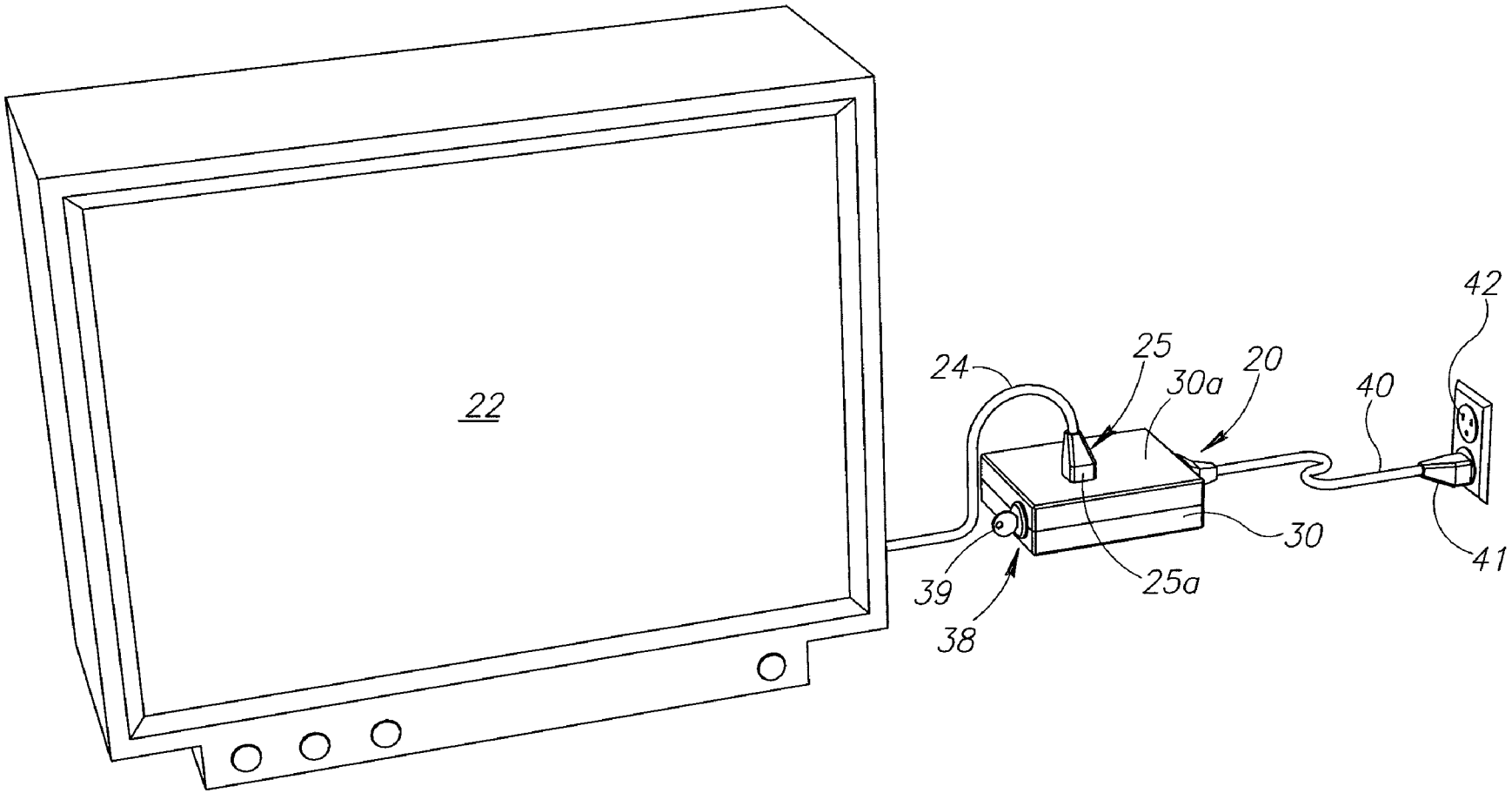
Figure 1C:
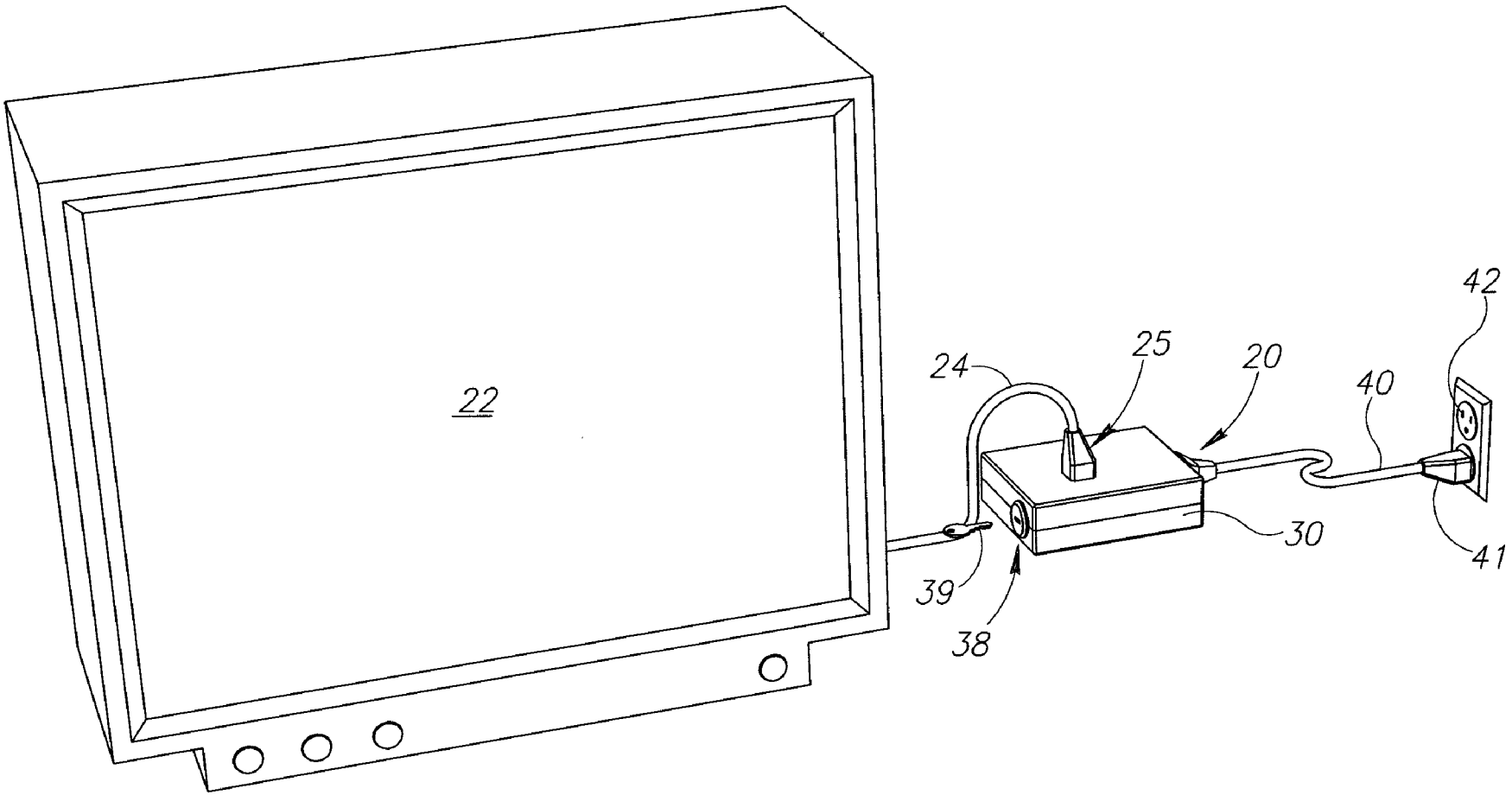
Figure 2A:
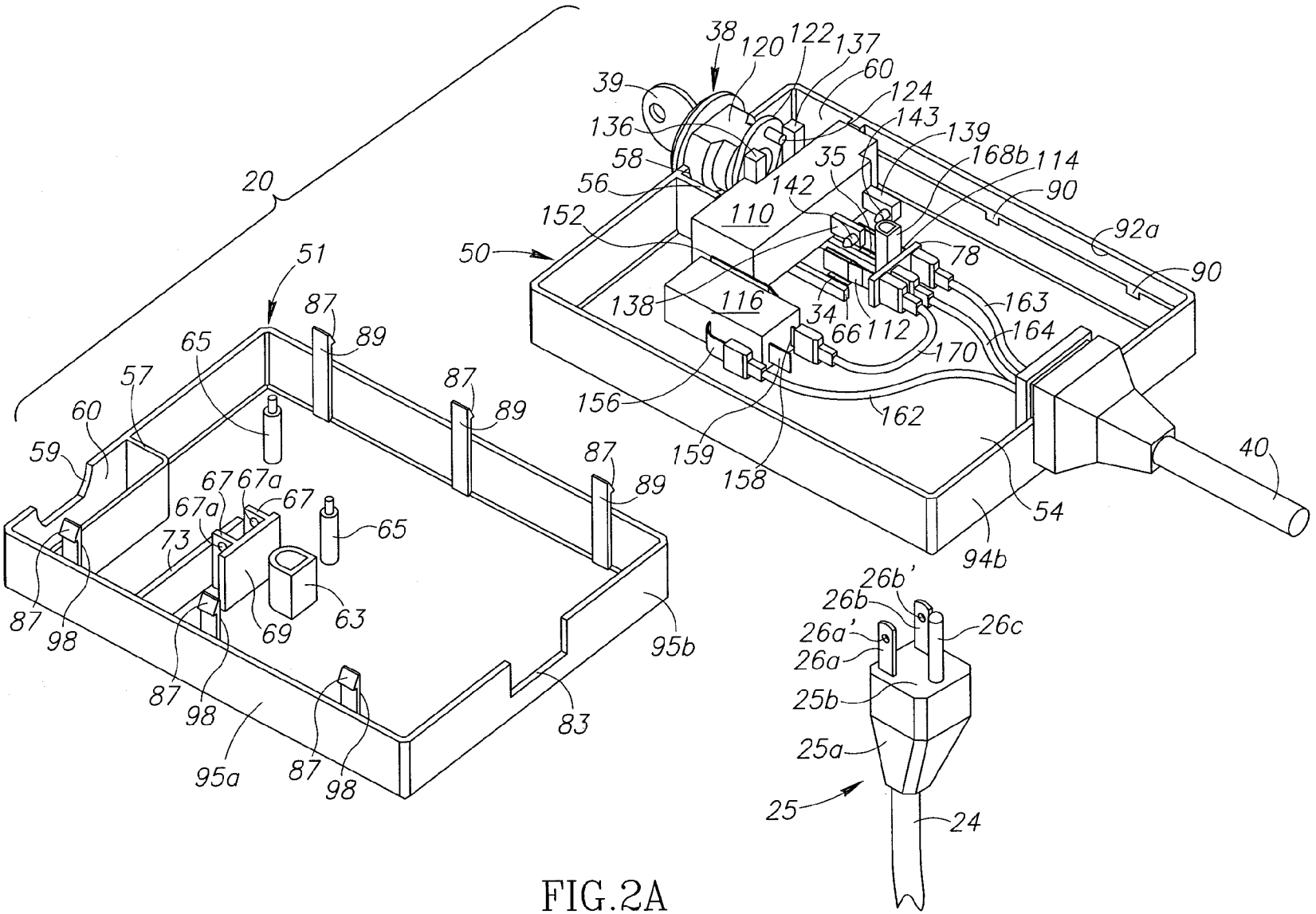
FIG. 2A is a perspective view of the apparatus in accordance with an embodiment of the invention, prior to entry of a plug.

FIGS. 1A-1C show the apparatus 20 of the invention in an exemplary use, with a electrical device 22, for example, a large electrical device such as a television, that is difficult to move from its present location, from which a cord 24 extends. The cord 24 terminates in a plug 25. The plug 25 includes a head 25*a*, a head surface 25*b*, and power prongs 26*a*, 26*b*, with apertures 26*a*', 26*b*', and a ground prong 26*c* (FIG. 2A). The apparatus 20 includes a body 30, with an area 32 of openings 34-36, along a first major surface 30*a*, for receiving both two and three prong plugs, such as the three prongs 26*a*-26*c* of the plug 25 of the device 22. The body 30 includes a locking structure 38, movable by a key 39. A power cord 40 (with a plug 41) typically extends from the body 30, to an electrical outlet 42, through which electric current to power the device 22 is obtained. While an apparatus 20 is shown with a cord 40 (as the source of electric current), the apparatus 20 may be a wall mounted unit, directly connected to the outlet 42 or directly wired as the outlet 42, with the outlet 42 serving as the current source.

FIG. 1A shows the apparatus 20 immediately before the plug 25 of the electrical device 22 is connected thereto. Alternately, this figure shows the apparatus 20 immediately after the plug 25 of the electrical device 22 is disconnected therefrom. The key 39 is in a position corresponding to an unlocked locking structure 38. The apparatus 20 in unlocked, such that it is ready to receive the plug 25 to provide power to the electrical device 22.

FIG. 1B shows the apparatus 20 with the plug 25 of the device 22 connected thereto and received therein. The locking structure 38 is in the unlocked position, whereby electric current is flowing between the outlet 42 and the apparatus 20, and to the electrical device 22.

FIG. 1C shows the apparatus 20 with the plug 25 of the device 22 connected thereto and received therein. The locking structure 38 is in the locked position, and the key 39 has been moved to a corresponding locked position, whereby electric current flow in the apparatus 20 has ceased, and accordingly, electric current is not flowing between the electrical device 22 and the outlet 42. The flow of current was broken by an open switch in the apparatus 20, that was opened upon the locking of the locking structure 38, when the key 39 moved from the unlocked position to the locked position. The key 39 is typically removable when the locking structure 38 is locked, and may also be removable when the locking structure 38 is unlocked, depending on the configuration of the tumbler and other components of the locking structure 38.

Turning to FIGS. 2A-2C, 3A and 3B, the apparatus 20 is shown in detail. Specifically, in these figures, the apparatus 20 is shown unlocked, to receive a plug or a plug has been removed from the apparatus 20.

The apparatus 20 has a body 30, that is formed of a base shell 50 and a correspondingly configured cover shell 51. The shells 50, 51 are joined in a locking arrangement, and when together, form an interior cavity 54, for the components of the apparatus 20. The base shell 50 is designed to carry the components, detailed below, and includes openings 34, 35, extending through the shell 50, from the major surface 30*a* to the cavity 54. These openings 34, 35 receive the power prongs of a two prong plug. There is also another opening 36 for receiving a ground prong of a three prong plug. A second major surface 30*b* extends along the cover shell 51. The planes formed by the first major surface 30*a* and the second major surface 30*b* are typically parallel, and define a major plane therebetween.

Each shell 50, 51 includes a divider wall 56, 57, and corresponding portions 58, 59, that when the shells 50, 51 are joined together, form a space 60 for receiving and securely confining the locking structure 38. The shells 50, 51 also include corresponding slot portions 62, 63 for receiving the ground prong of a plug, and post portions 64, 65, for securely retaining components, i.e., the switch 116, in a fixed position, when the shells 50, 51 are joined together. The base shell 50 includes guide walls 66. When coupled with aligned guide walls 67, with apertures 67*a* (corresponding to apertures 26*a*', 26*b*' in power prongs 26*a*, 26*b* of a plug 25, for example, as shown in FIGS. 1A-1C and 2A), and perpendicularly oriented walls 69, of the cover shell 51, the guide walls 66, 67 of the coupled base 50 and cover 51 shells, serve as guides for the power prongs of the plug upon entry into the apparatus 20. The perpendicularly oriented wall 69 contacts support walls 66, 70, when the cover shell 51 is joined with the base shell 50.

The base shell 50 includes a cut away section 56*a* along its divider wall 56, and a parallel support wall 70, with perpendicularly disposed support walls 72, all of the same height as the cut away section 56*a*. This arrangement forms a support on which a slide lock or bolt 110 is movable, by sliding, between first and second positions, as detailed below. In the cover shell 51, a wall 73, corresponding to the support wall 70 (in the base shell 50), at the same height as the divider wall 57, couples with the divider wall 56 and support walls 70, 72 of the base shell 50. When the shells 50, 51 are combined, these walls 56, 57, 70, 72 and 73 serves to provide a space in which vertical and horizontal movement (sliding) of the slide lock or bolt 110 is confined.

In the base shell 50, the space 76 between the cut-away portion 56*a* of the divider wall 56 and support wall 70 defines a groove. Supports 78, to which the electrical contacts 112, 114 attach (as well as electrical wires) are disposed on opposite sides of the ground prong slot portion 62.

The base shell 50 and cover shell 51 include corresponding cut-outs 82, 83 for accommodating the power cord 40 or the like. The shells 50, 51 lock together, when combined, as outwardly tapered tabs 87 are at the ends of fingers 89 in the cover shell 51, that frictionally engage correspondingly shaped and correspondingly aligned detents 90 in the base shell 50, along the inner walls 92*a*, 92*b*. Additional attachment of the shells 50, 51 may be made with adhesives, mechanical fasteners and the like. The base shell 50 and cover shell 51, when joined, fit securely and have a flush side outer surfaces 94*a*, 94*b*, 95*a*, 95*b*. These outer side surfaces 94*a*, 94*b*, 95*a*, 95*b* are typically perpendicular to the major surfaces 30*a*, 30*b*.

The shells 50, 51 are typically of a plastic, polymeric or other non-electrically conductive material. The shells 50, 51 are typically single pieces with all divider walls 56, 57, slot portions 62, 63, posts 64, 65, walls 67, 69, 70, 72, 73, fingers 89 and detents 90, integral with the respective shells 50, 51, The shells 50, 51 are typically formed by techniques, such as injection molding, blow molding and the like.

The base shell 50 typically supports the components of the apparatus 20. These components include a locking structure 38, a slide lock or bolt 110, electrical contacts 112, 114, and a switch 116. The electrical contacts 112, 114, the switch 116, and the power cord 40 (serving as a current source), that couples with an electrical device through a plug, define a circuit for providing electric current to the electrical device.

The locking structure 38, typically includes a cam lock 120, accessible by the key 39. The cam lock 120 may be, for example, such that it accommodates a one quarter turn (over an approximately 90 degree arc, typically a 90 degree arc) of the key 39, from a typically perpendicular orientation with respect to the major plane of the apparatus 20, to a typically parallel orientation with respect to the major plane of the apparatus 20. The cam lock 120 includes a movable or rotatable cam 122 at its inner end, that terminates in a stub 124. The stub 124 is dimensioned to seat between posts 136, 137 of the slide lock 110, such that turning the key 39 rotates the cam 122, whereby the stub 124 contacts the posts 136, 137, to move the slide lock or bolt 110 between first and second positions, and vice versa, detailed below.

Figure 3A:
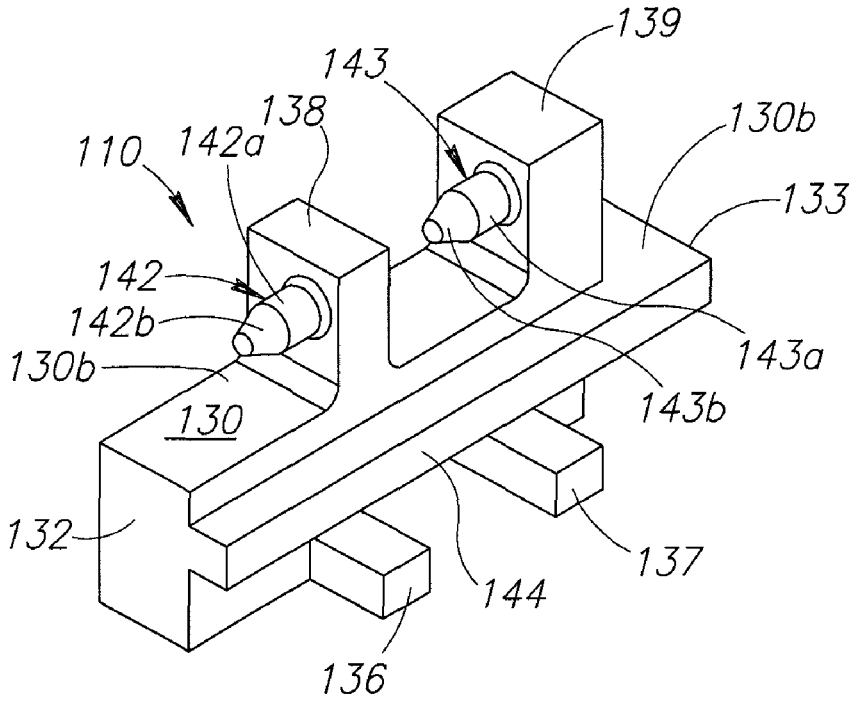
FIG. 3A is a perspective view of a slide lock of the apparatus of FIG. 2A.
Figure 3B:
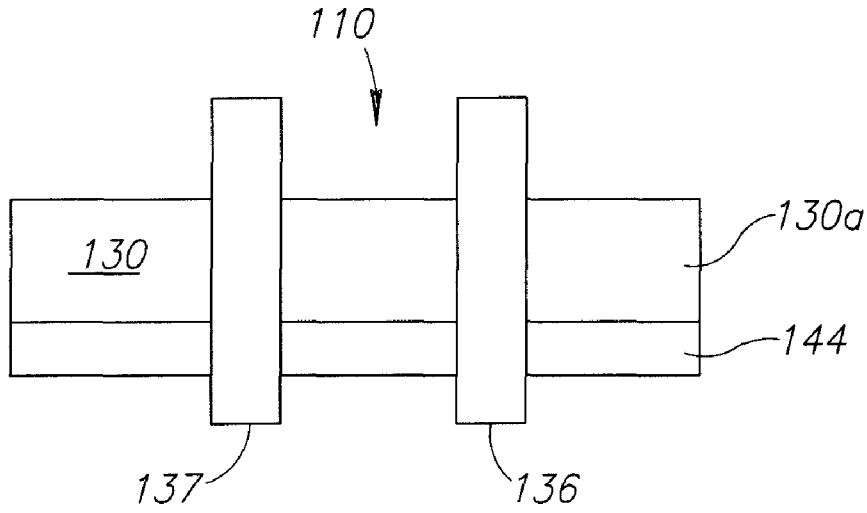
FIG. 3B is a front view of the slide lock of FIG. 3A.

The slide lock or bolt 110, as shown in FIGS. 3A and 3B, is typically, formed of a body 130, with a head end 132 and a tail end 133. The posts 136, 137 are positioned on one side 130*a* of the body 130, and extend beyond the body 130, to bound and confine the stub 124 of the cam 122. Arms 138, 139 extend from the body 130 at the other side 130*b*, with pins 142, 143 extending from the arms 138, 139. The arms 138, 139, are typically spaced apart from each other at a distance corresponding to the distance of the power prongs of a standard plug.

The pins 142, 143 typically include a cylindrical body 142*a*, 143*a*, with a conical head 142*b*, 143*b*. The cylindrical body 142*a*, 143*a* is of a diameter slightly less than the diameter of the aperture of a plug, in order to extend through the apertures of the power prongs (for example, apertures 26*a*', 26*b*' of power prongs 26*a*, 26*b* of the plug 25) when locking the plug in the apparatus 20 is desired, as shown in FIGS. 5A-5C. Also, as shown in FIGS. 4A, 4B and 5A-5C, the pins 142, 143 are positioned on the arms 138, 139 so as to be aligned with the apertures of the power prongs of a standard plug, when the plug head 25*a*, at its surface 25*b* (FIG. 2A) abuts the major surface 30*a* on the base shell 50 of the apparatus 20.

The slide lock or bolt 110 includes a ridge 144, protruding from the body 130, and extending the length of the body 130. The ridge 144 seats in the space 76 in the base shell 50, so as to move (slide) in a groove, such that horizontal movement of the slide lock 110 is confined. The side of the body 130*a* is supported by the dividing wall 56, and travel of the slide lock 110 is limited by the cut away portion 56*a* of the dividing wall 56. The other side 130*b* of the body 130 and arms 138, 139 is supported by the support walls 70, 72, that are the same height as the cut-away portion 56*a* of the divider wall 56.

The slide lock or bolt 110 is typically an integral member of a plastic, polymeric or other non-electrically conductive material. It is typically formed as a single piece, by techniques, such as injection molding, blow molding, and the like.

The electrical contacts 112, 114 are typically arranged to include a neutral contact 112 and a positive contact 114. The contacts 112, 114 are typically folded-over pieces of electrically conductive metal, such as copper, alloys thereof, or other electrically conductive materials. The folded-over shape of the contacts 112, 114 allows for frictional contacts with the power prongs of the plug, while the power prongs extend beyond the halves 112*a*, 112*b*, 114*a*, 114*b* that form the contacts 112, 114, when the plug is properly received in the apparatus 20, as shown in FIGS. 4A, 4B and 5A-5C and detailed below.

The switch 116, is for example, a micro switch, that is moved between closed and open positions, by movement of the slide lock 110, when the slide lock 110 moves from a first position to a second position, as detailed below. The switch 116 is typically biased in the closed position (shown by the circle 150), such that this normally biased closed position is an on-condition for the switch 116 (where current flows through the switch 116). A member 152 typically extends from the switch 116. Contact from the head end 132 of the body 130 of the slide lock 110 (when moved to the second position), moves the member 152, opening the switch 116, creating an off-condition. When the head end 132 of the slide lock 110 moves out of contact with the member 152, or is out of contact with the member 152, so that the switch 116 is closed (in the on-condition), the slide lock 110 is in a first position. Conversely, when the head end 132 of the slide lock 110 moves into contact with the member 152, or is in contact with the member 152, so that the switch 116 is open (in the off-condition), the slide lock 110 is in a second position.

The switch 116 includes a common terminal 156, a normally closed terminal 158, and a normally open terminal 159, through which electrical connections are made. The switch may be, for example, a micro switch rated at 15 Amps, such as the micro switch commercially available as Part No. VT16001C2 from Highly Electric Company, 782 Heritage Drive, Ft. Lauderdale, Fla. 33326.

Specifically, the circuit is wired as the power cord 40, here, for example, the current source, is typically a two wire cord, with a "hot" wire 162, a neutral wire 163, and a ground wire 164. The "hot" wire 162 is electrically connected to the common terminal 156. The neutral wire 163 is electrically connected to the positive contact 114, at its end 114*c*. The ground wire 164 connects to a lead 168*a* of a ground contact 168 (for contacting the ground prong of a plug) (both the lead 168*a* and ground contact 168*b* of an electrically conductive material), that is in the slot portion 62. A jumper wire 170 electrically connects the neutral contact 112, at its end 112*c* to the normally closed terminal 158 of the switch 116. By connecting at the normally closed terminal 158 of the switch 116, the normal or default position of the switch 116 is closed (in the on-condition), whereby electric current is flowing between the power cord 40 and the contacts 112, 114. The aforementioned electrical connections are made with conventional connectors 172. For example, the connectors 172 may be crimp on connectors for 0.187×0.020 contact 14 GA. wire that are preattached to the wire, for example, wires 162, 163, 164 and 170.

Attention is now directed also to FIGS. 4A, 4B and 5A-5C to detail the operation of the apparatus 20. Operation is the same if the apparatus 20 is used with either a two or three prong plug. The difference is that with a three prong plug, the ground prong (for example, ground prong 26*c* of the plug 25 of FIGS. 1A and 2A) is received in the opening 36 of the apparatus 20 and the ground prong is confined in the slot portions 62, 63 in the shells 50, 51.

Figure 2B:
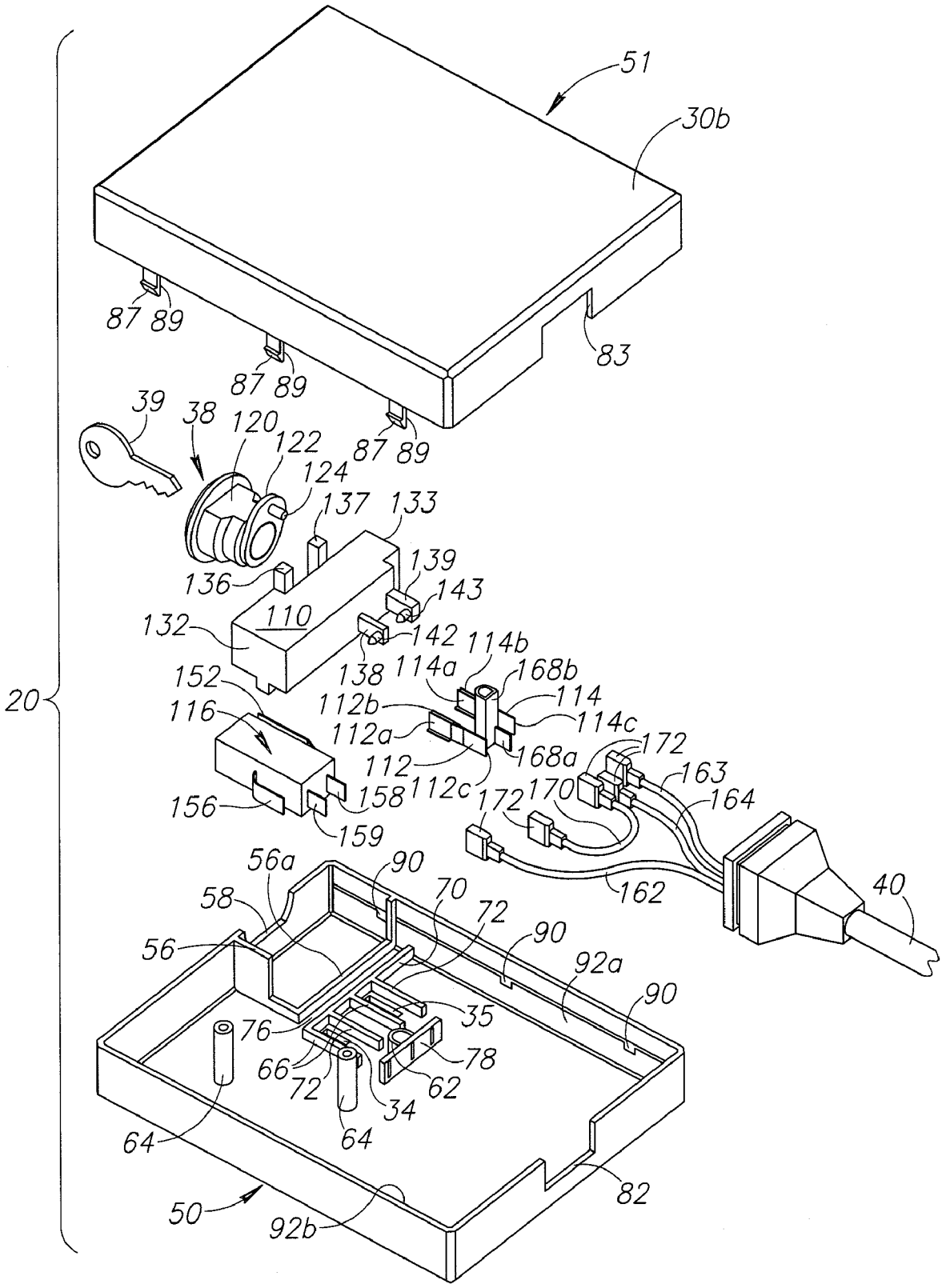
FIG. 2B is an exploded view of the apparatus of FIG. 2A.
Figure 2C:
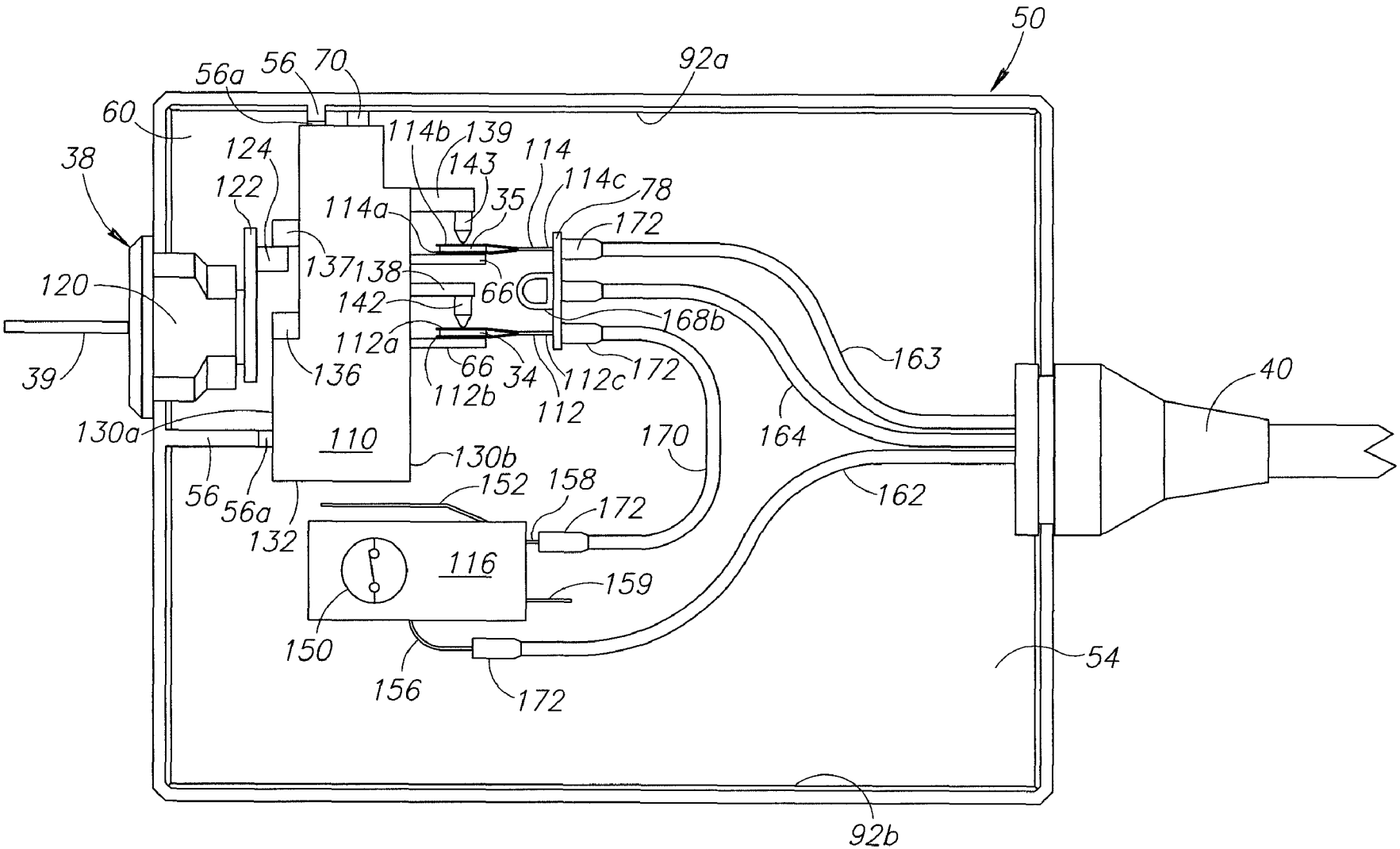
FIG. 2C is a top view of the apparatus of FIG. 2A with the cover shell removed.
Figure 4A:
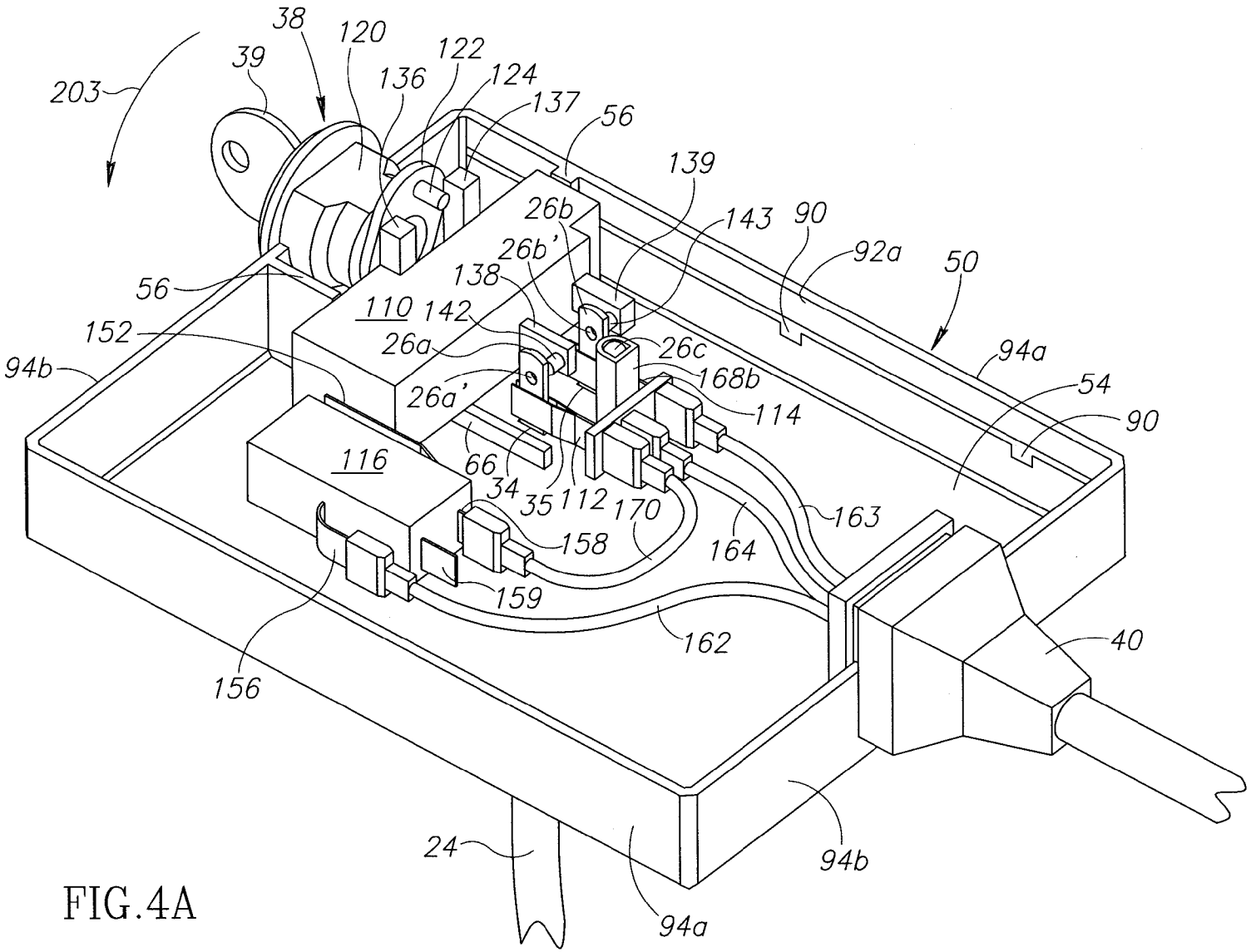
FIG. 4A is a perspective view of the apparatus of FIG. 2A with the cover shell removed in operation, and the power prongs of a plug unlocked.
Figure 4B:
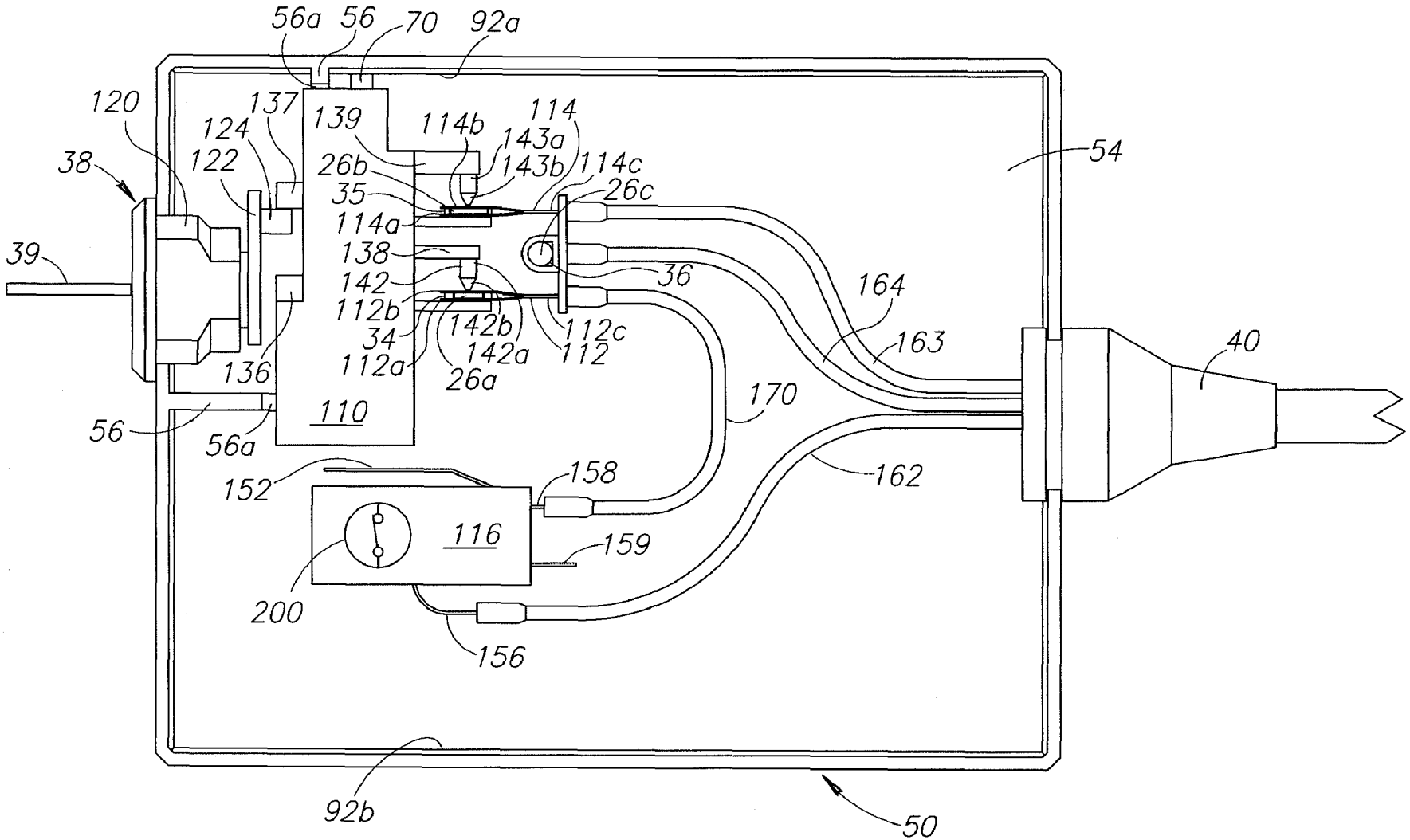
FIG. 4B is a top view of the apparatus of FIG. 4A.
Figure 5A:
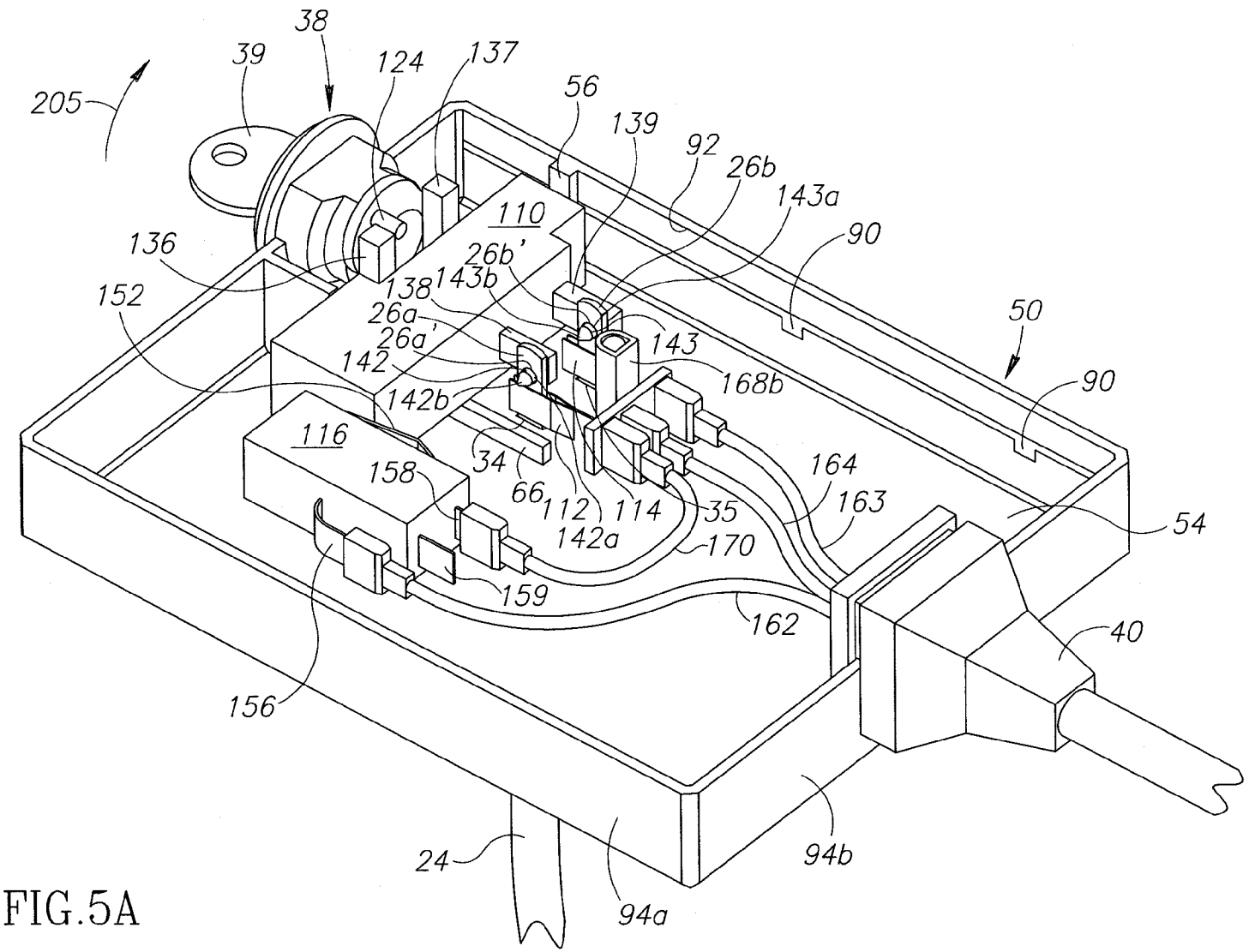
FIG. 5A is a perspective view of the apparatus of FIG. 2A with the cover shell removed in operation, and the power prongs of the received plug are locked.
Figure 5B:
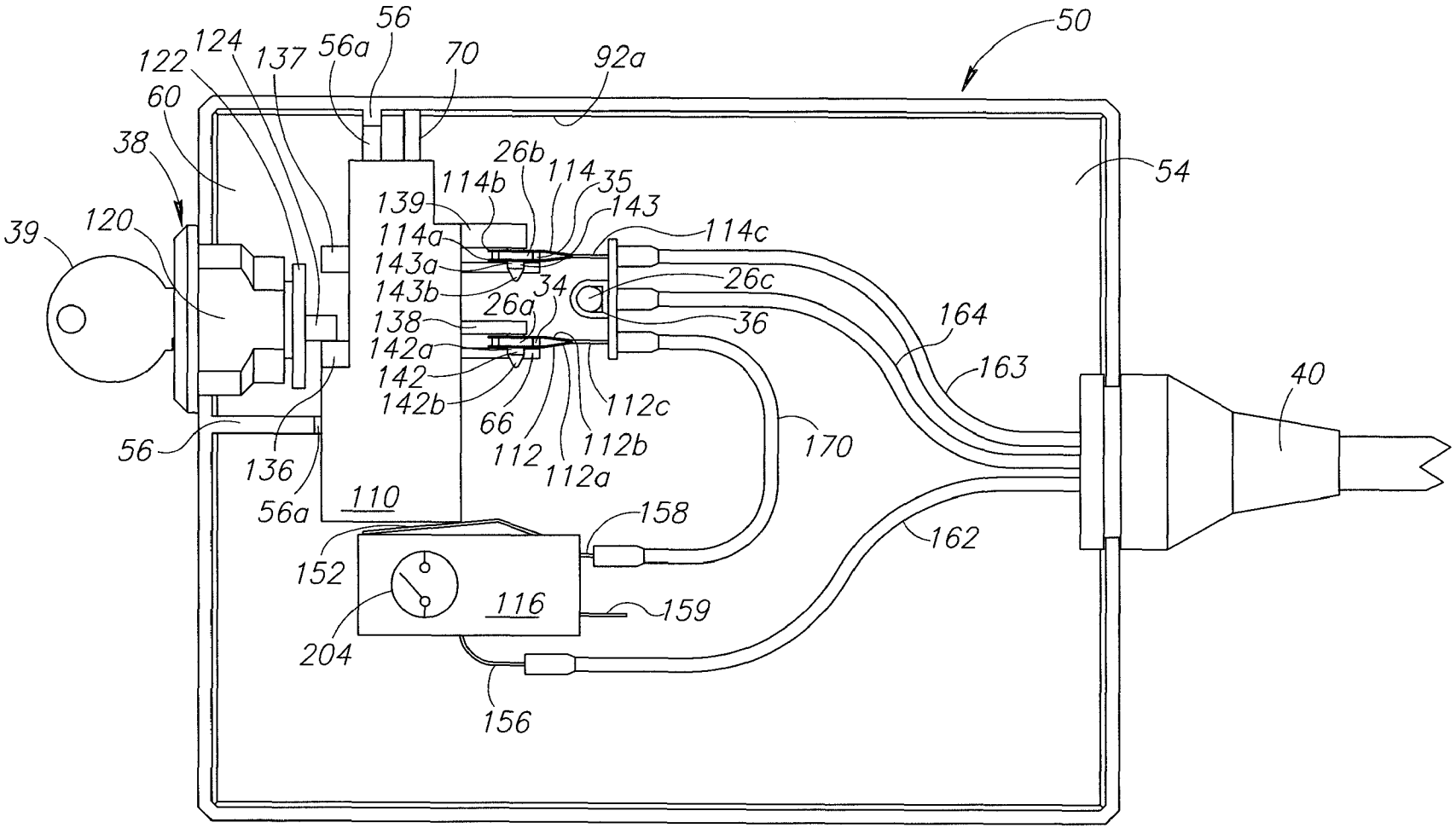
FIG. 5B is a top view of the apparatus of FIG. 5A.
Figure 5C:
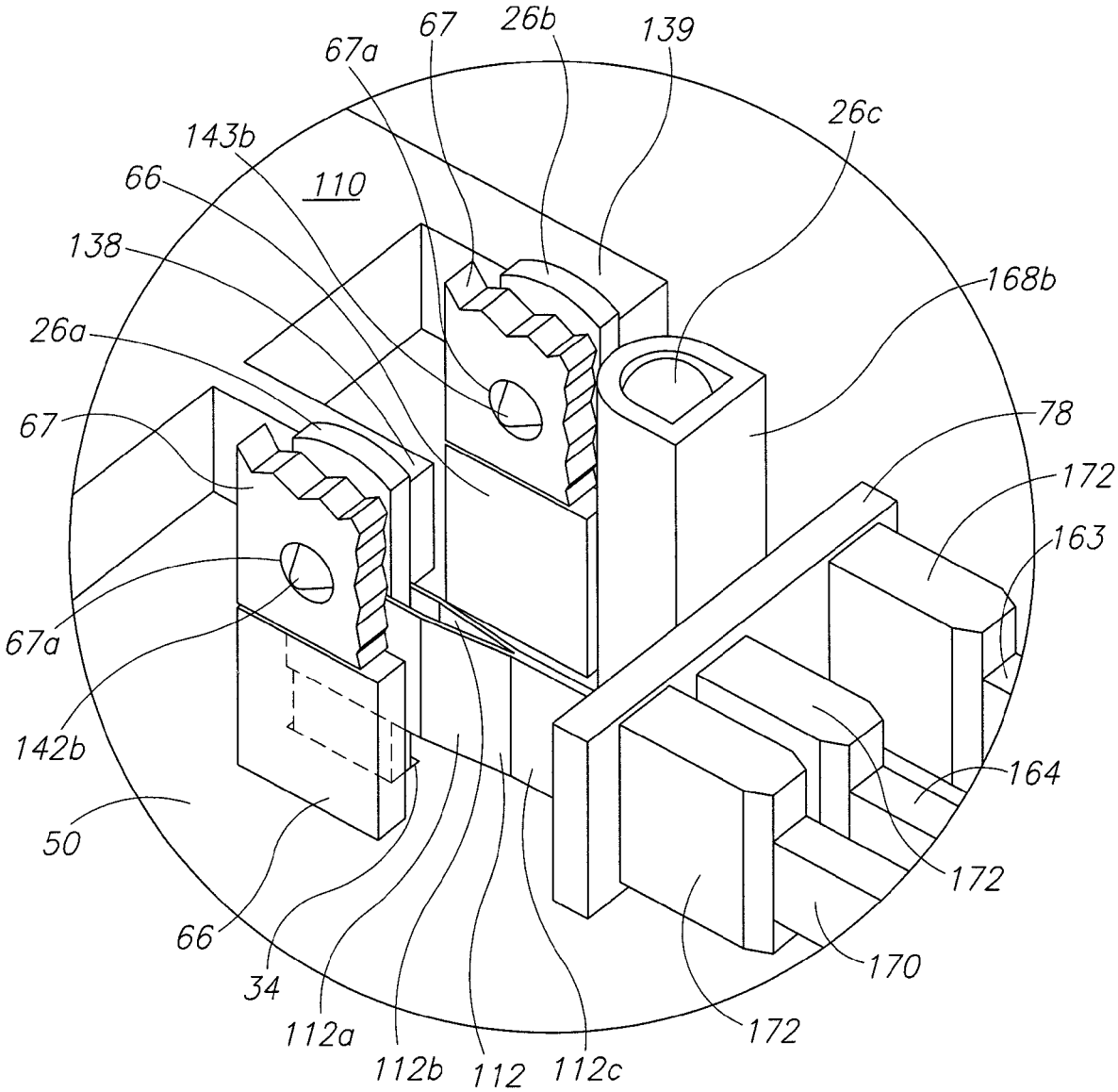
FIG. 5C is a detailed view of the locking of the power prongs of the plug of FIG. 5A.

As shown in FIGS. 4A and 4B, a plug 25 (such as that shown in FIGS. 1A and 2A) has been placed into the apparatus 20. The power prongs 26*a*, 26*b* are received in, and extend through, the openings 34 and 35, and the ground prong 26*c* is received in, and extends through, the opening 36 in the base shell 50. The plug head 25*a* abuts the major surface 30*a* of the body 30 of the apparatus 20. Within the cavity 54, the apertures 26*a*', 26*b*' of the power prongs 26*a*, 26*b* are aligned with the respective pins 142, 143, as well as the apertures 67*a* of the guide walls 67 (FIGS. 2B and 5C). Current is flowing to the plug 25 (and the electrical device associated therewith), as the switch 116 is in the closed position (an on-condition), as indicated by the circle 200. The plug 25 and electrical device (not shown) as attached to the apparatus 20, result in a closed circuit, formed by the apparatus 20, the power cord 40 (the current source), and the electrical device (not shown).

The head end 132 of the slide lock 110 is out of contact with the member 152 on the switch 116. The key 39 is perpendicular to the major plane of the apparatus 20. Accordingly, the slide lock 110 is in a first position, where the stub 124 of the cam 122 abuts the outer post 137, and the slide lock 110 is proximate to the inner wall 92*a* of the shell 50.

When disabling the power supply in the apparatus 20, is desired, the key 39 is, for example, rotated clockwise (in the direction of the arrow 203 in FIG. 4A) in the locking structure 38, for example, by a one quarter or 90 degree turn, to a position parallel to the major plane of the apparatus 20, as shown in FIGS. 5A-5C. Rotation of the key 39 has rotated the cam 122 clockwise into contact with the inner post 136, to slide the slide lock 110, to a second position, such that its head end 132 is in contact with the member 152. The contact with the member 152 opens the switch 116 (as indicated in the circle 204), such that electric current is no longer flowing through the apparatus 20. Movement of the slide lock 110 moves the arms 138, 139 toward the respective power prongs 26*a*, 26*b*, causing the respective pins 142, 143, to move into and through the apertures 26*a*', 26*b*' of the power prongs 26*a*, 26*b*, with the heads 142*b*, 143*b* of the pins extending into the apertures 67*a* of the guide walls 67, as shown in FIG. 5C. The plug 25 is now locked in the apparatus 20. The key 39 can be removed, and the plug 25, through the apertures 26*a*' 26*b*' in the power prongs 26*a*, 26*b*, remains locked in the apparatus 20, with current flow through the apparatus disabled, such that the electrical device, associated with the plug 25 can not be operated.

Should operation of the electrical device be desired, or resumed, the key 39 is reinserted into the locking structure 38, and turned (for example, one quarter, or 90 degrees) to the vertical position (with respect to the major plane), such that the apparatus 20 is unlocked, as shown in FIGS. 4A and 4B. Movement of the key 39, (for example, a counterclockwise rotation of the key 39 along a 90 degree arc, in the direction of the arrow 205, as shown in FIG. 5A) moves the cam 122 and the stub 124, that contacts the post 137, moving the slide lock 110 back to the first position, away from the switch 116, and toward the inner wall 92*a* of the shell 50. With the slide lock 110 having been moved out of contact with the member 156, the switch 116 is closed (moved to an on-condition), where current is again flowing through the apparatus 20. Additionally, the pins 142, 143 have been moved out of and clear of the apertures 26*a*', 26*b*' of the power prongs 26*a*, 26*b*, as movement of the slide lock 110 moves the arms 138, 139 accordingly. The plug 25 may be removed from the apparatus 20 if desired, without damaging it or the apparatus 20.

There have been shown and described preferred embodiments of power control devices and methods for their use. It is apparent to those skilled in the art, however, that many changes, variations, modifications, and other uses and applications for the apparatus, its components, and methods for its use are possible, and also such changes, variations, modifications, and other uses and applications which do not depart from the spirit and scope of the invention are deemed to be covered by the invention, which is limited only by the claims which follow.

What is claimed is:

1. A power control device comprising:

a first contact;

a second contact;

a switch in electrical communication with at least one of the first contact or the second contact;

the first contact, the second contact, and the switch defining a portion of a circuit configured for electrically coupling with a current source, and when power prongs of a plug are in electrical contact with the first contact and the second contact define a circuit, with the electrical device associated with the power prongs of the plug; and, a bolt movable between positions for activating and deactivating the switch, such that the portion of the circuit configured for coupling with the current source and the electrical device is closed and opened upon movement of the bolt between the positions, the bolt including a portion configured for individually locking each of the power prongs of a plug when the bolt is in a position where the switch is deactivated, and the bolt in a position such that said each of the power prongs of the plug are unlocked when the switch is activated.

2. The power control device of claim 1, wherein the switch is closed when activated and open when deactivated.

3. The power control device of claim 2, wherein the switch is in an on-condition when closed and an off-condition when open.

4. The power control device of claim 1, further comprising:

a key lock assembly in communication with the bolt, the key lock assembly movable by a key, between a first position, where the bolt is out of contact with the switch and the switch is activated, and a second position, where the bolt is in contact with the switch and the switch is deactivated.

5. The power control device of claim 4, wherein, the key lock assembly includes a cam in communication with the bolt, such that movement of the key moves the cam for moving the bolt.

6. The power control device of claim 1, wherein the portion of the bolt for locking the power prongs of a plug includes arms, each arm including a pin for extending at least into the aperture of each power prong of a plug.

7. The power control device of claim 6, wherein arms are spaced apart at a distance corresponding to the spacing of the power prongs of a plug.

8. The power control device of claim 4, additionally comprising:

a housing for supporting, the first contact, the second contact, the bolt, the switch and the key lock assembly, and configured for receiving a current source, the housing including openings for the power prongs of a plug.

9. The power control device of claim 8, wherein the housing additionally includes an opening for the ground prong of a plug.

10. The power control device of claim 8, wherein the bolt is slideable in the housing.

11. The power control device of claim 8, additionally comprising: an electrical line in electrical communication with the first contact, the second contact and the switch, the electrical line defining a source of electric current for the power control device, the electrical line extending from the housing.

12. The power control device of claim 11, wherein the electrical line includes a plug for receipt in an electrical outlet.

* * * * *